United States Patent [19]

Futatsuishi et al.

[11] Patent Number: 4,495,719

[45] Date of Patent: Jan. 29, 1985

[54] MOVABLE DISPLAY APPARATUS

[75] Inventors: Shunichi Futatsuishi; Shozo Fujita; Takashi Takushima, all of Nagasaki, Japan

[73] Assignee: Mitsubishi Denki Kabushiki Kaisha, Tokyo, Japan

[21] Appl. No.: 363,687

[22] Filed: Mar. 1, 1982

[30] Foreign Application Priority Data

Mar. 2, 1981 [JP] Japan ..... 56-30064[U]

[51] Int. Cl.[3] ..... G09F 21/04

[52] U.S. Cl. ..... 40/590; 40/591; 40/601

[58] Field of Search ..... 40/590, 605, 610, 589, 40/591, 592, 593, 601, 588; 280/656, 760, 763, 766, 768; 272/21; 296/24 R, 21

[56] References Cited

U.S. PATENT DOCUMENTS

| | | | |
|---|---|---|---|
| 649,622 | 5/1900 | Uting | 40/590 |
| 862,904 | 8/1907 | Harrison | 40/590 |
| 862,904 | 8/1907 | Harrison | 40/590 |
| 1,906,762 | 5/1933 | Maynes | 40/590 |
| 3,435,909 | 4/1969 | Wenger | 272/21 |
| 3,692,350 | 9/1972 | Radtke | 296/21 |
| 4,019,773 | 4/1977 | Vehling | 296/21 |

FOREIGN PATENT DOCUMENTS

| | | | |
|---|---|---|---|
| 389697 | 9/1908 | France | 40/590 |
| 331521 | 6/1930 | United Kingdom | 40/590 |

*Primary Examiner*—Gene Mancene
*Assistant Examiner*—Cary E. Stone
*Attorney, Agent, or Firm*—Sughrue, Mion, Zinn, Macpeak & Seas

[57] ABSTRACT

A display apparatus for use with a vehicle-mounted display board includes a flat plate made up of a plurality of plate pieces which surround and offset the display board during exhibition. For transport, the plate pieces are disposed around members associated with the display apparatus, to protect these members and the board from damage.

3 Claims, 3 Drawing Figures

MOVABLE DISPLAY APPARATUS

BACKGROUND OF THE INVENTION

The invention relates to a moveable display apparatus.

FIG. 1 illustrates a side view of one example of a conventional movable display apparatus. In the drawing, reference numeral 1 designates a display portion, 2*a*–2*c* a display-control section and a lift-control section, 3 a structural member for supporting the display portion, 4 a table mounting the structural member 3, 5 a lift for lifting the display portion 1 together with the table 4, 6 the chassis of a vehicle for transporting the display, including wheels 7 and a tractor 8.

According to the conventional apparatus thus constructed, the height of the display portion 1 is changeable by controlling the lift. That is, during transportation, the display portion 1 is at a descent position so as to more easily drive the vehicle, and when the vehicle reaches its destination, the display portion is lifted to the ascent position by means of the lifter, and thus is capable of effectively reaching a large audience. However, during display, many parts other than the display portion 1, for example the display-control section 2*a*, 2*b*, the structural member 3, the table 4 and the lifter 5 are all visible to the audience, so that the displaying efficiency is disadvantageously degraded.

SUMMARY OF THE INVENTION

It is thus an object of this invention to overcome the drawbacks incident to the conventional apparatus, and to provide a movable display apparatus capable of enhancing displaying efficiency by means of the attachment of simple member to the conventional apparatus.

BRIEF DESCRIPTION OF THE DRAWINGS

The invention will be described with reference to the drawings, which show one embodiment thereof.

FIGS. 2 and 3 are side views showing an embodiment of the invention, wherein FIG. 2 illustrates the displaying state and FIG. 3 illustrates a transport state.

DETAILED DESCRIPTION OF THE PREFERRED EMBODIMENTS

Figure 1:
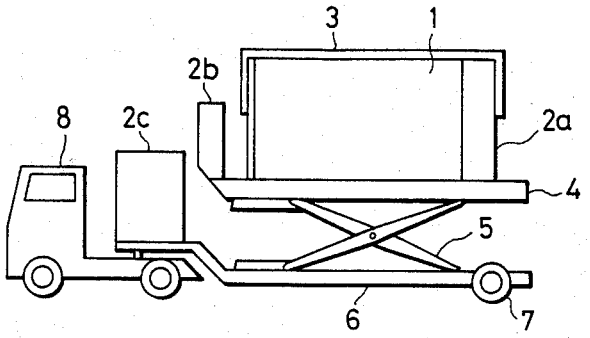
FIG. 1 PRIOR ART
FIG. 1 is a side view illustrating a conventional movable display apparatus in the displaying state.
Figure 2:
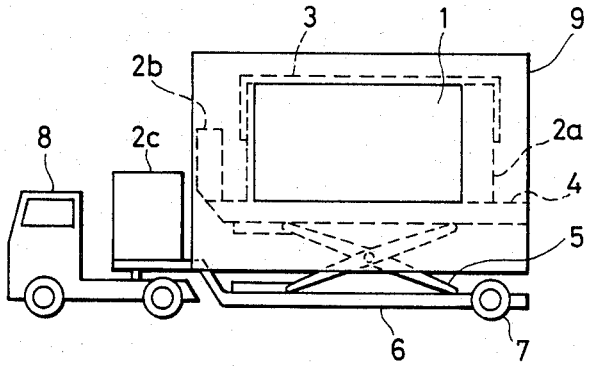
Figure 3:
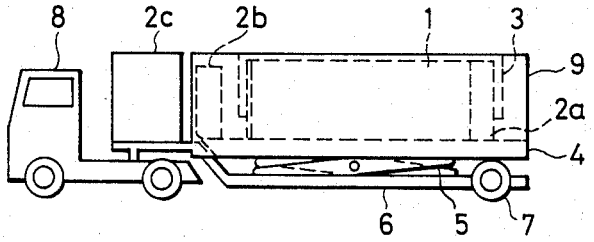

FIGS. 2 and 3 are side views showing one embodiment according to the invention, wherein like parts and components are designated by the same reference numerals as those in FIG. 1, and reference numeral 9 designates a flat plate. The plate 9 consists of a plurality of flat plate pieces, and as shown in FIG. 2, the flat plate 9 can be disposed surrounding the display portion 1 (shown in solid lines in FIG. 2), or can be disposed around the members associated with the display portion, for example the members 3 and 4, as shown in FIG. 3.

According to the movable display apparatus of the invention, thus constructed, where the flat plate 9 is disposed around the display portion 1, the plate serves to cover the other mechanical members disposed adjacent to the display portion 1, to thus enhance displaying efficiency.

On the contrary, during transportation, the flat plate pieces can be disposed around the members associated with the display portion, so that damage of these mechanical members due to collision or the like can be prevented.

Further, according to this construction, during display, in addition to the enhancement of the outer appearance, the degradation of displaying efficiency due to background or incoming light can be prevented in outdoor displays by coloring the flat plate black. The black-colored flat plate is in high contrast to the display portion 1, to thus promote displaying efficiency, and further, if desired, the advertisement can be provided on the flat plate itself, to increase the size of the advertisement.

What is claimed is:

1. A moveable display apparatus comprising a display board having a vertically disposed flat display surface mounted on a vehicle for supplying information to a large audience, lift means for raising and lowering said display board relative to said vehicle, and a plurality of flat plate members moveably associated with said display board, said flat plate members being assembled around said vertical display surface of said display board in parallel flush relation thereto when said display board is disposed in the raised position for hiding said lift means and providing a peripheral frame for said display surface and said flat plate members being assembled about said display board in the lowered position to cover said display board to protect said display board from damage during transport.

2. A moveable display apparatus as set forth in claim 1 wherein said flat plate members are of a color high in contrast to the display board.

3. A moveable display apparatus as set forth in claim 2 wherein said plate members are black colored.

* * * * *